US006615691B2

(12) United States Patent
Coonrad

(10) Patent No.: US 6,615,691 B2
(45) Date of Patent: Sep. 9, 2003

(54) STRIKING TOOL

(75) Inventor: Todd Douglas Coonrad, Santa Cruz, CA (US)

(73) Assignee: Douglas Tool, Inc., Santa Cruz, CA (US)

( * ) Notice: Subject to any disclaimer, the term of this patent is extended or adjusted under 35 U.S.C. 154(b) by 0 days.

(21) Appl. No.: 10/266,818

(22) Filed: Oct. 7, 2002

(65) Prior Publication Data

US 2003/0037641 A1 Feb. 27, 2003

Related U.S. Application Data

(63) Continuation of application No. 09/814,021, filed on Mar. 20, 2000, now Pat. No. 6,460,430, which is a continuation of application No. 09/435,318, filed on Nov. 4, 1999, now Pat. No. 6,131,488, which is a continuation of application No. 09/234,042, filed on Jan. 19, 1999, now Pat. No. 5,988,019, which is a continuation of application No. 09/064,205, filed on Apr. 21, 1998, now Pat. No. 5,860,334, which is a continuation of application No. 08/624,178, filed on Mar. 25, 1996, now Pat. No. 5,768,956.

(51) Int. Cl.[7] ..... B25D 1/00
(52) U.S. Cl. ..... 81/20
(58) Field of Search ..... 81/20, 26; D8/75, D8/78, 79, 80

(56) References Cited

U.S. PATENT DOCUMENTS

| | | | | | |
|---|---|---|---|---|---|
| 378,650 | A | * | 2/1888 | Bigelow | 81/20 |
| 967,703 | A | * | 8/1910 | Bagnall | 403/243 |
| 1,508,874 | A | * | 9/1924 | Christensen | 403/253 |
| 4,367,969 | A | * | 1/1983 | Carmien | 403/253 |
| D275,261 | S | * | 8/1984 | Crowder | D8/75 |
| 4,773,286 | A | * | 9/1988 | Krauth | 81/20 |
| 5,012,702 | A | * | 5/1991 | Taylor | 81/25 |
| 5,537,896 | A | * | 7/1996 | Halder | 81/26 |
| 5,768,956 | A | * | 6/1998 | Coonrad | 81/20 |
| 5,860,334 | A | * | 1/1999 | Coonrad | 81/20 |
| 5,988,019 | A | * | 11/1999 | Coonrad | 81/20 |
| 6,131,488 | A | * | 10/2000 | Coonrad | 81/20 |
| 6,250,181 | B1 | * | 6/2001 | Coonrad | 81/20 |
| 6,460,430 | B2 | * | 10/2002 | Coonrad | 81/20 |

OTHER PUBLICATIONS

U.S. patent application Ser. No. 09/814,021, Coonrad, no date available.

* cited by examiner

*Primary Examiner*—Joseph J. Hail, III
*Assistant Examiner*—David B. Thomas
(74) *Attorney, Agent, or Firm*—Donald R. Boys; Central Coast Patent Agency, Inc.

(57) ABSTRACT

A head-to-handle interface for a striking tool having a plane of symmetry has a web in the plane of symmetry and sidewalls around the periphery of the web except for the direction of joining the handle to the head, the web and sidewalls forming socket areas on both sides of the web, such that a handle shaped to engage the sockets is joined to the head in a manner that bending stresses are greatly alleviated at and near the head-to-handle interface. In one embodiment a variable weight system provides for a user varying the weight of the head of a striking tool. In another aspect, a nail-pulling slot is provided with significantly tapered inner walls.

11 Claims, 13 Drawing Sheets

STRIKING TOOL

CROSS-REFERENCE TO RELATED DOCUMENTS

The present application is a continuation of application Ser. No. 09/814,021 filed Mar. 20, 2000, now U.S. Pat. No. 6,460,430 issued Oct. 8, 2002, which is a continuation of Ser. No. 09/435,318 filed Nov. 4, 1999 now U.S. Pat. No. 6,131,488 issued Oct. 17, 2000, which is a continuation of Ser. No. 09/234,042 filed Jan. 19, 1999, now U.S. Pat. No. 5,988,019 issued Nov. 23, 1999, which is a continuation of Ser. No. 09/064,205 filed Apr. 21, 1998, now U.S. Pat. No. 5,860,334 issued Jan. 19, 1999, which is a continuation of Ser. No. 08/624,178 filed Mar. 25, 1996, Now U.S. Pat. No. 5,768,956 issued Jun. 28, 1998. All referenced applications are incorporated herein in there entirety by reference.

FIELD OF THE INVENTION

The present invention is in the area of hand-held striking tools, such as hammers and pickaxes, and pertains more specifically to joining handles and heads for such tools, accommodating a demand for a variety of weights for such tools, and improving claw hammer versatility.

BACKGROUND OF THE INVENTION

Hand-held striking tools, such as claw hammers, mallets, sledge hammers, ball peen hammers, masonry hammers, pickaxes, and the like, have been used by people in a variety of disciplines for centuries as leveraged devices to provide a striking force to accomplish a seemingly endless variety of tasks. For example, a claw hammer, commonly weighing from 7 to 32 ounces is used by people doing carpentry work to deliver sufficient striking force to drive a nail into wood. A claw hammer is also used for removing a nail or ripping apart lumber using it's claw. A sledge hammer, commonly weighing from 2 to 20 pounds, is used to deliver sufficient striking force for heavy work such as driving a stake, awl drill, chisel, or driving a wedge into masonry, stone, wood, or other hard materials.

Another common hand-held striking tool is a ball peen hammer, which has a substantially flat surface on one end and a rounded surface on the other end of its head, and is used to deliver sufficient striking force for shaping and fitting metal, and for driving machine chisels, rivet sets, machine wedges, and other similar tools. A pickaxe is another example of a hand-held striking tool which is commonly used for loosening hard dirt and stones, and also used as a lever for prying heavy objects from the ground. Another common hand-held striking tool is a mallet, which is usually made of wood, plastic, rubber, or soft iron. A mallet provides a striking force to drive chisels or shape metal and other materials without significantly marring the material it strikes.

Hand-held striking tools, such as those described above, are commonly used as third-class levers used to provide a striking force to accomplish tasks such as driving a nail into a piece of wood, bending or forming metal, breaking a rock, and other similar tasks. Third class levers are levers where a fulcrum, also referred to as a pivot point, is at one end of a bar or rod. A load to be overcome is an object creating resistance at the opposite end of a bar or rod. An effort, or force, to be applied to a third-class lever is somewhere in between a fulcrum and load. In the case of a hand-held striking tool such as a claw hammer, the fulcrum is a wrist, the force is provided by deceleration of the movement of a hammer handle (bar or rod) at the wrist, and the load is a resistance presented by a piece of wood into which the nail is being driven.

In another example, a hand-held striking tool such as a pickaxe, the fulcrum is also a wrist, the force is provided deceleration of the movement of a pickaxe handle (rod) at the wrist, and the load is a resistance presented by dirt or stones into which the sharp point of the pickaxe is driven.

The head of a hand-held striking device is commonly a significant distance from the fulcrum and moves faster than the movement being applied at a user's hand, which is near the fulcrum. The increased speed of the head multiplies the applied force with which a striking device head strikes a nail or digs into the dirt. The longer a claw hammer's handle, for example, the faster the head and the greater the force that strikes a nail and overcomes the resistance of the wood. This principle applies to all other hand-held striking devices, and is intensified in long-handled striking devices such as a pickaxe or an axe.

Hand-held striking tools are also commonly used as first-class levers to provide a lifting or prying force to accomplish a variety of tasks. For example, some hand-held striking devices are used to pull nails out of a pieces of wood, tear apart pieces of wood or other building material, pry loose a large rock, lift a log, and the like. First class levers are levers wherein he load to be overcome is at or near one end of a rod or bar, the effort, or force is applied at or near the other end of the same rod or bar, and the fulcrum, or pivot, is somewhere along the rod or bar in between the applied force and load.

An example of a hand-held striking tool being used as a first class lever is a claw hammer being used to pull out nails, wherein the load to be overcome is the wood causing friction against an embedded nail. Another example of a hand-held striking tool being used as a first class lever is a pickaxe being used to pry out a rock or tree root embedded in dirt or rock, where the load to be overcome is the dirt or rock causing friction against an embedded rock or tree root. Whenever a hand-held striking tool is used as a first class lever, the force is applied at one end of a long handle. The fulcrum is typically near the other end of the handle which holds the head.

The load for a hand-held striking tool being used as a first class lever, such as in a claw hammer or a pickaxe, is typically very close to the fulcrum. Whereas the force for a hand-held striking tool being used as a third class lever is typically relatively far away from the fulcrum. During prying or pulling tasks, the load applied is therefore moved less distance than the hand, which is at the opposite end of the lever, and applying the force. This multiplies the force in which the claw hammer head pulls against a nail, or a pickaxe pulls against a rock.

The weakest part of a hand-held striking device is the interface between the handle and the head. The conventional method of interfacing a striking device head and handle, which are typically made of distinct materials, such as metal and wood, allows striking and pulling stresses to promote head-to-handle loosening, damage, and separation. For example, the impact force at the head of a claw hammer, being used as a third class lever against a nail, is often as high as 300 pounds. Because of the greater length of its handle and greater weight of its head, the striking force of the head of a pickaxe against the earth is many times greater.

The bending moment applied at the head-to-handle interface of a claw hammer being used as a first class lever to pull out a nail is often as high as 1,000 foot-pounds. The bending moment levied against the head-to-handle interface of a pickaxe pulling heavy rocks away from the earth is typically many times more.

The effect of these forces is exacerbated when a user occasionally misses his target and strikes the handle of such a tool against a hard object, such as the edge of a piece of wood, or a rock, at the head-to-handle interface just below the head. This causes further damage and weakens a head-to-handle interface.

Because of the inherent weakness in conventional head-to-handle interfaces, it is at this point that most failures in hand-held striking devices occur. Methods have been devised to make head-to-handle interface configurations capable of withstanding impacts and pulling stresses described above without damage. These methods include using a handle made with a material, such as high-impact plastic or heavy-gage rolled steel, that has particularly high strength and resiliency to withstand extremely high impacts and pulling stress. These types of handles are typically encapsulated in a resilient material, such as natural or synthetic rubber, leather, or plastic, to provide some protection from the shock from impact and to give a user a good grip on the handle. Many users of hand-held striking devices, however, still prefer the look and feel of wooden handles.

As stated above, a problem with many conventional methods for increasing handle strength on hand-held striking devices is the inherent weakness in the design of interfaces. Current interfaces for hand-held striking tools typically comprise a handle whose end is shaped to make a tight fit through a shaped opening in the head. Such a shaped opening is often tapered so the fit can be tightened by driving the head in the direction against the taper. This interface is typically made secure by a variety of methods. In one conventional method, for example, wooden handles are often secured by metal or wooden wedges or cylinders forced into the top of the handle after the handle is inserted into the head. This expands the wood so it makes a tight fit against the inner surfaces of the opening. A tight fit, however, does little to increase the strength of the conventional head-handle interface.

In another method, metal handles may be made tight to a head with an opening by heating the head and/or cooling the handle significantly to create a relatively loose fit. This allows easy insertion of the handle into the hole in the head. After insertion of a handle into the hold in a head, the metal head and handle return to ambient temperature, and the opening in the head contracts and/or the metal handle expands to produce a tight fit.

Another common method for securing conventional head-to-handle interfaces is by placing a bonding material, such as an epoxy adhesive, between the inner surface of the opening in the head and outer surface of the interface end of the handle.

The types of head-to-handle interfaces and methods of securing described above are commonly used on all types of hand-held striking tools, such as axes, sledge hammers, pickaxes, and the like. A problem with these conventional solutions is that the striking and pulling forces are concentrated over a short distance at the interface. The intensified stress at this small area is the cause of most hand-held striking tool failure. Head-to-handle interfaces made according to conventional art, regardless of the material of the handle or method of securing it to the head opening, often fail because of this concentrated stress.

As describe earlier, hand-held striking devices typically come in a variety of weights, depending upon the task at hand or the physical condition of the user. For example, claw-hammers used for general carpenter work, commonly referred to as a curved-claw nail hammer, are typically manufactured and sold in weights from 7 to 20 ounces. Claw hammers designed and used for rough work such as framing, opening crates and prying apart boards, commonly referred to as ripping hammers, are typically manufactured and sold in weights from 20 to 32 ounces. The primary difference between a curved nail hammer and a ripping hammers is that the ripping hammer has a substantially straighter and longer claw than a curved nail claw.

Another example of weight variations in hand-held striking tools are sledge hammers. These hand-held striking devices are used to apply heavy duty striking forces against objects. They are manufactured and sold in weights from 2 to 20 pounds. Many other striking tools, such as pickaxes, axes, mallets, and the like also are typically manufactured and sold in a range of weights to suit the needs of a user.

A user, particularly a professional, commonly may need a hand-held striking tool in two or more weights to accommodate a particular task at hand or his current physical condition. Assume, for example, a carpenter lying on his back inside an attic of a small alcove at a home construction site installing braces above him. He or she might prefer a light nail-pulling hammer, such as 16 ounces, to accommodate the fact that he or she must swing the hammer up against gravity with a small space for arm movement. The same carpenter, who later moves to a different home construction site to remove foundation forms and install floor joists may choose a heavier ripping hammer, such as 30 ounces. This will enable him or her to take advantage of the downward force of gravity and greater area to swing the hammer. A disadvantage in current art is, in situations like these, the carpenter must purchase and care for two or more separate hammers, which adds to his cost and maintenance.

As described above, the common two types of claw hammers are the curved-claw nail hammer, used for light carpentry work, and the ripping hammer, which is typically used for heavy rough work with wood. A curved-claw nail hammer is well suited for pulling nails because the curve of its claw provides increased leverage because the nail (load) is placed close to the end of the handle near the lever's fulcrum. A curved-claw nail hammer is not well suited for ripping tasks because the curve of its claw makes it difficult to fit between planks and make a direct cutting blow to tear into materials, such as plaster wall.

A ripping hammer, on the other hand, is well-suited for tearing apart planks and breaking into materials, such as a plaster wall, because its relatively straight claw fits more readily between planks and angles, and its cutting edge (wedge) points directly away from the hammer's head. A ripping hammer is typically not well-suited for pulling nails because the width of its claw to ensure adequate ripping strength preclude placing a nail pulling slot close to the fulcrum for increased leverage. A user, particularly a professional, often purchases one or more curved-claw nail hammer and one or more ripping hammer to accommodate his or her need to perform specialized nailing or ripping tasks. This adds to a user's costs and maintenance for their care.

What is clearly needed is a head-to-handle interface for hand-held striking devices that can minimize bending stresses at head-to-handle interface when using a wooden handle, or a handle made from any suitable material.

What is also clearly needed is a method to change the weight of a hand-held striking device to accommodate a user's changing weight needs without purchasing two or more of the same type of striking device.

What is also clearly needed is a claw hammer that is equally suitable for pulling nails as it is for ripping boards and other materials to accommodate a user's changing needs without requiring the user to purchase two or more different claw hammers.

SUMMARY OF THE INVENTION

In a preferred embodiment a head for a striking tool is provided, comprising a head portion having a plane of substantial symmetry, a length in the plane of substantial symmetry from a first end to a second end, a height at a right angle to the length, and a striking head at the first end; and a handle interface portion extending away from the head portion in the direction of the height of the head portion for a distance at least equal to the height of the head portion. The head for a striking tool is characterized in that the striking head is joined to the handle interface portion by a web in the plane of substantial symmetry and the handle interface portion includes a web also in the plane of substantial symmetry. In some embodiments there may be a second striking head at the second end, wherein the second striking head is also joined to the handle interface portion by a web also in the plane of substantial symmetry.

In a preferred embodiment the striking tool head is a hammer head, further comprising a nail-pulling claw extending to the second end, wherein the nail-pulling claw is also joined to the handle interface portion by a web also in the plane of substantial symmetry.

In some embodiments there is at least one reinforcing web substantially at right angles to the plan of substantial symmetry, which in preferred begins in the head portion on one side of a center axis of the interface portion, extends accurately toward the center axis and the handle interface portion, crosses the center axis, and forms an edge wall to one edge of the web in the plane of substantial symmetry of the handle interface portion. In some embodiments the striking tool may be a claw hammer.

In some preferred embodiments there are two reinforcing webs in planes at right angles to the plane of substantial symmetry, the two reinforcing webs beginning in the head portion, one on each side of the center axis of the interface portion, extending accurately toward each other and toward the handle interface portion, crossing substantially at the center axis, and forming edge walls on both edges of the web in the plane of substantial symmetry of the handle interface portion. Some of these tools are hammers as well. In this case the reinforcing webs form walls around parts of the handle interface portion, providing sockets on opposite sides of the interface web for engaging handles.

In further preferred embodiments striking tools are provided wherein the heads of the striking tools have the features described above relative to striking tool heads.

In all the preferred embodiments of the invention new and novel apparatus is provided giving users of striking tools products of superior and enhanced strength and durability over any such tools previously available in the art.

DESCRIPTION OF THE PREFERRED EMBODIMENTS

The present invention in various embodiments overcomes an inherent weakness in conventional head-to-handle interface methods to provide a durable, long-lived head-to-handle interface for hand-held striking devices. It also provides a method and apparatus to facilitate changing the weight of a hand-held striking device. This feature accommodates a user's varying weight needs without requiring purchase of two or more of the same type of striking device.

The present invention in various embodiments also provides a type of claw hammer that is well-suited for both pulling nails and ripping boards and other materials. This obviates the need for a user to purchase and care two or more types of claw hammers.

Figure 1A:
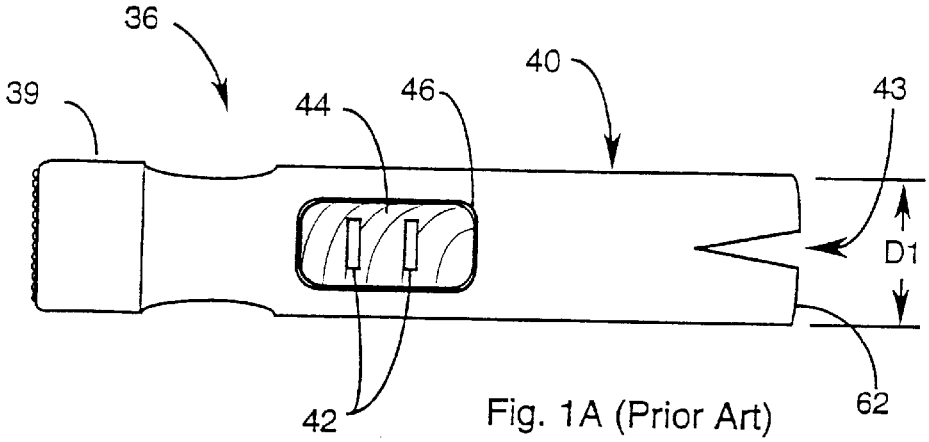
Fig. 1A (Prior Art)
FIG. 1A is a top view of the head of a conventional claw hammer.
Figure 1B:
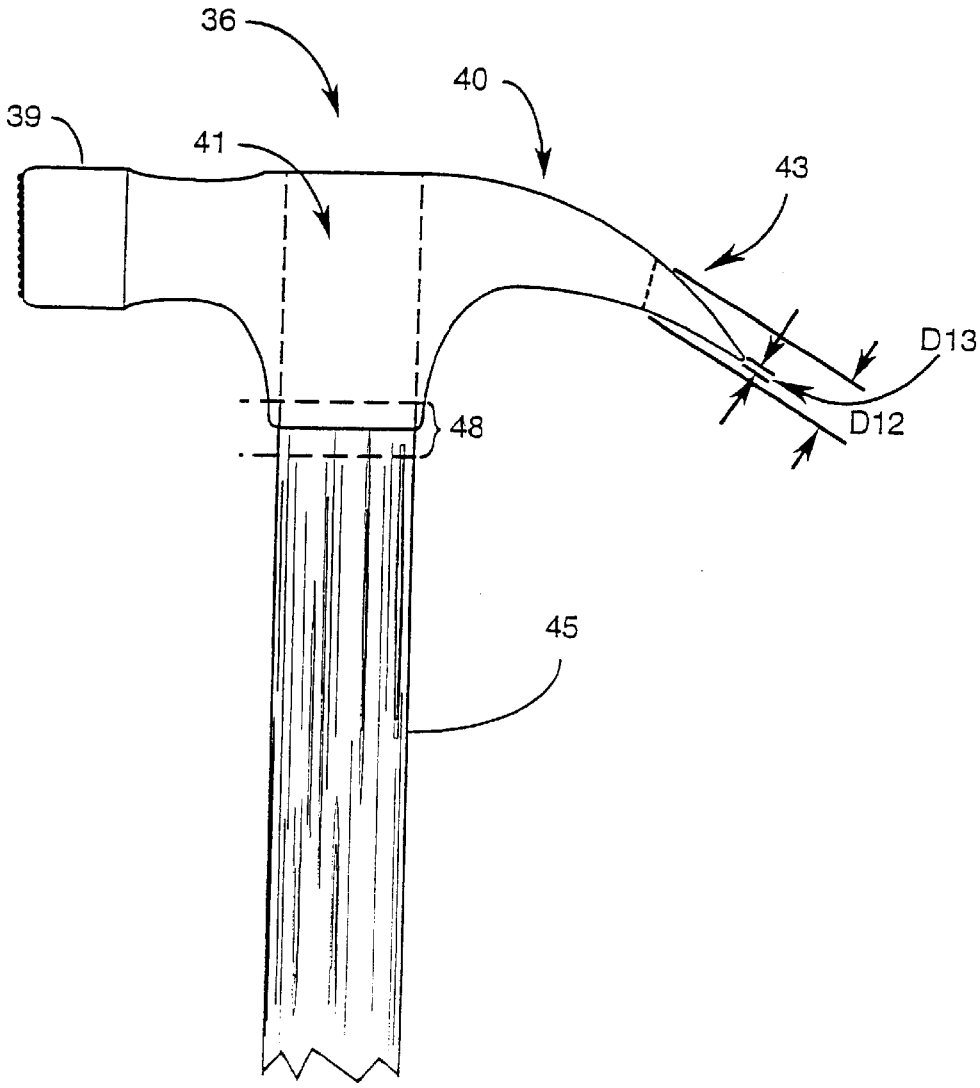
Fig. 1B (Prior Art)
FIG. 1B is a left side view of the conventional claw hammer of FIG. 1A, showing the head-to-handle interface.

FIGS. 1A and 1B are top and side views of a conventional claw hammer, showing parts that are typical to hand-held striking devices, and parts peculiar to a conventional claw hammer. Parts common to many hand-held striking devices are an impact head 39 and a head-to-handle interface 41. Impact head 39 for a claw hammer typically has a substantially flat surface of sufficient size at its end for easily striking a head of a nail.

Impact heads of many sizes and shapes are manufactured and sold to suit the peculiar use of a hand-held striking device. For example, a ball-peen hammer impact head typically has one substantially flat head at one end, and a substantially rounded impact head on the other end. This combination provides a user with flexibility to strike a material, such as metal, a variety of ways at angles to conform the material to a desired shape. A pickaxe typically has two elongated impact heads that are pointed at their ends so they will penetrate dirt, rocks, or any desired surface. An axe commonly has one or two impact heads that have sharp wedges to allow a user to cut into wood or other materials.

Head-to-handle interface 41, shown in FIGS. 1A and 1B, is a common configuration for many types of hand-held striking devices. It comprises interface opening 46 in hammer head 36, and retaining wedges 42. Interface opening 46 is a substantially rectangular opening of suitable size and shape to insert, and make a tight fit for, a similarly shaped hammer handle interface end 44. Retaining wedges 42 are driven into the handle interface end 44 after assembly of the head to the handle to expand handle interface end 44 so its outer surface fits tightly against the inner surface of interface opening 46. This is a conventional method for holding a hammer head to a handle.

In the conventional arrangement of FIG. 1A and FIG. 1B, use of the hammer for either striking or pulling concentrates stress in a relatively small region, which is region 48 shown in FIG. 1B. A concentration of high bending moments is generated as head 36 strikes a nail or other surface, which causes a force reaction in the direction opposite to the head movement.

There are also instances wherein a hammer head misses the intended target, and the target is struck at or near the interface area. This happenstance creates an even greater bending moment at the interface than the usual striking action. Also, in pulling nails and the like, bending moments are concentrated at the head-to-handle interface. The combination of these stresses degrades the integrity of a head-to-handle interface over time. Looseness and eventual separation result, and in some instances the handle fails at the interface. Most people have experienced such a broken handle in one or another of the various types of striking and pulling tools.

Parts in FIGS. 1A and 1B that are peculiar to claw hammers are a conventional claw 40 having a wedge shape 62, and conventional nail-pulling slot 43. Conventional claw 40 is either substantially curved or only slightly curved, depending on its primary use as a nail-pulling claw or a ripping claw. In both cases, the working end of claw 40 is wedge-shaped and usually has a nail-pulling slot 43. The height of nail-pulling slot 43 substantially conforms to wedge thickness along its length, such as at heights D12 and D13. As will be discussed later, this characteristic limits the ability of a user to grip and pull nails when the nail heads are close to the surface of a material into which the nails are embedded.

Figure 2:
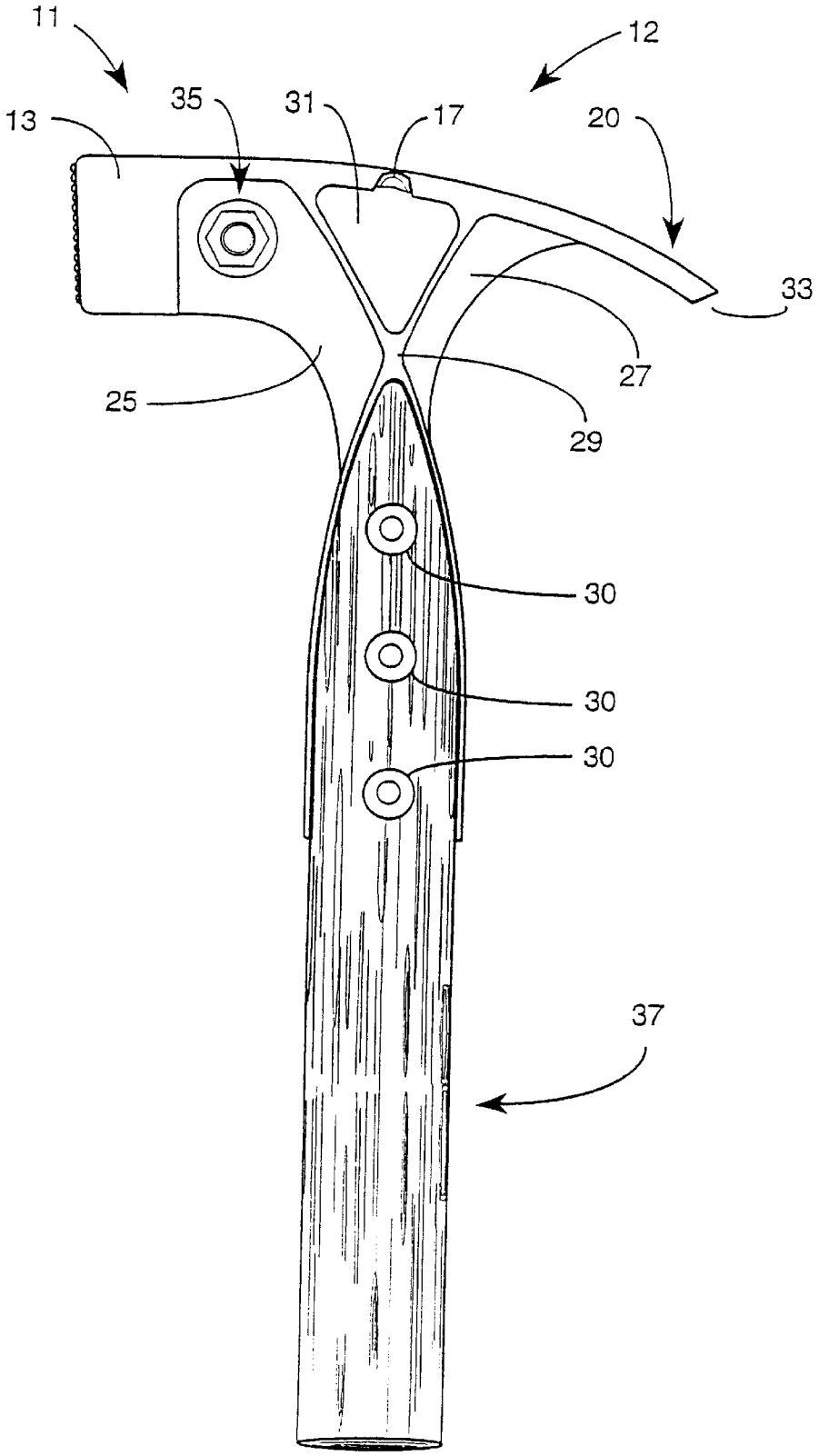
FIG. 2 is a left side overview of a claw hammer according to an embodiment of the present invention.

FIG. 2 is a left side view of a claw hammer 12 according to an embodiment of the present invention. Claw hammer 12 comprises a claw hammer head 11 and handle 37. Hammer head 11 comprises an impact head 13, an optional adjustable weight assembly 35, structural webbing areas 25, 27, and 31, cross braces 29, a head-to-handle interface region 19 (FIG. 3), an optional side nail-pulling slot 17, a claw 20 having a chamfered claw end 33, and a tapered nail-pulling slot 34 (not shown, but described elsewhere). Claw hammer 12 has significantly greater head-to-handle interface integrity, plus versatility in weight and claw use than does the conventional claw hammer configuration already described.

Most hammer heads in the prior have a nearly constant width such as width D1 in FIG. 1A. Hammer head 11 differs in that the several parts are distinct and connected by reinforcing webbing. This structure is shown in FIG. 3A, but will be better understood by referring to FIG. 8A, to be fully described later, then returning to FIG. 3A.

Impact head 13 of hammer head 11 is similar to the impact head of a conventional hammer, except in hammer head 11, impact surface 15 is inclined at an angle of from 2 to 5 degrees with vertical when the long axis of the hammer handle is vertical. The inventor has found that this inclination provides for driving nails straighter than with hammers lacking such inclination. Another difference with conventional hammers is that the impact head extends from impact surface only a relatively short distance, usually about one inch or less, shown as dimension D2 in FIG. 3A.

Yet another significant departure from conventional hammer design is in the claw. Whereas conventional claws are formed by tapering the width of the hammer head in gentle curvature, providing a claw with diminishing thickness toward the claw end, as shown in FIG. 1B, claw 20 in the present embodiment is a curved section with substantially constant width D3. An edge for ripping and tearing is formed by a chamfered end 33.

Claw 20 in this embodiment has an optional side nail-pulling slot 17, and a tapered nail-pulling slot 34 (not shown here, but described later). Claw 20 in the present embodiment has greater strength and functionality for ripping and nail pulling tasks than does a conventional claw.

In hammer head 11, impact head 13 and claw 20 are joined to a head-to-handle interface region 19 by structural reinforcing webbing regions 25 and 27 and by brace elements 21A and 21B at right angles to webbing regions 25 and 27. Brace elements 21A and 21B are crossed in an integral arrangement to provide maximum strength while presenting also a pleasing and distinct visual effect.

Figure 3A:
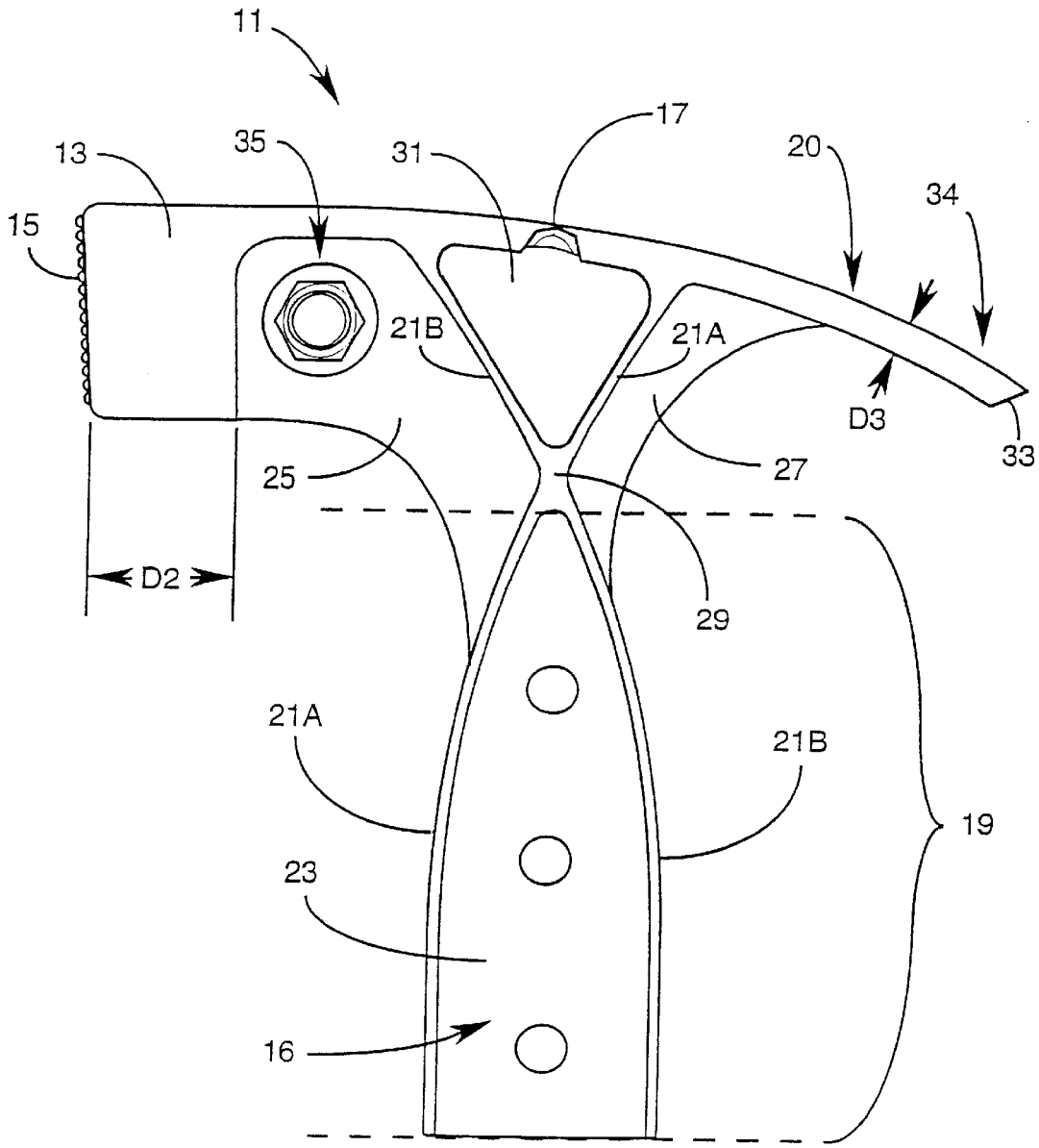
FIG. 3A is a left side view of the head and head-to-handle interface of the claw hammer of FIG. 2.
Figure 3B:
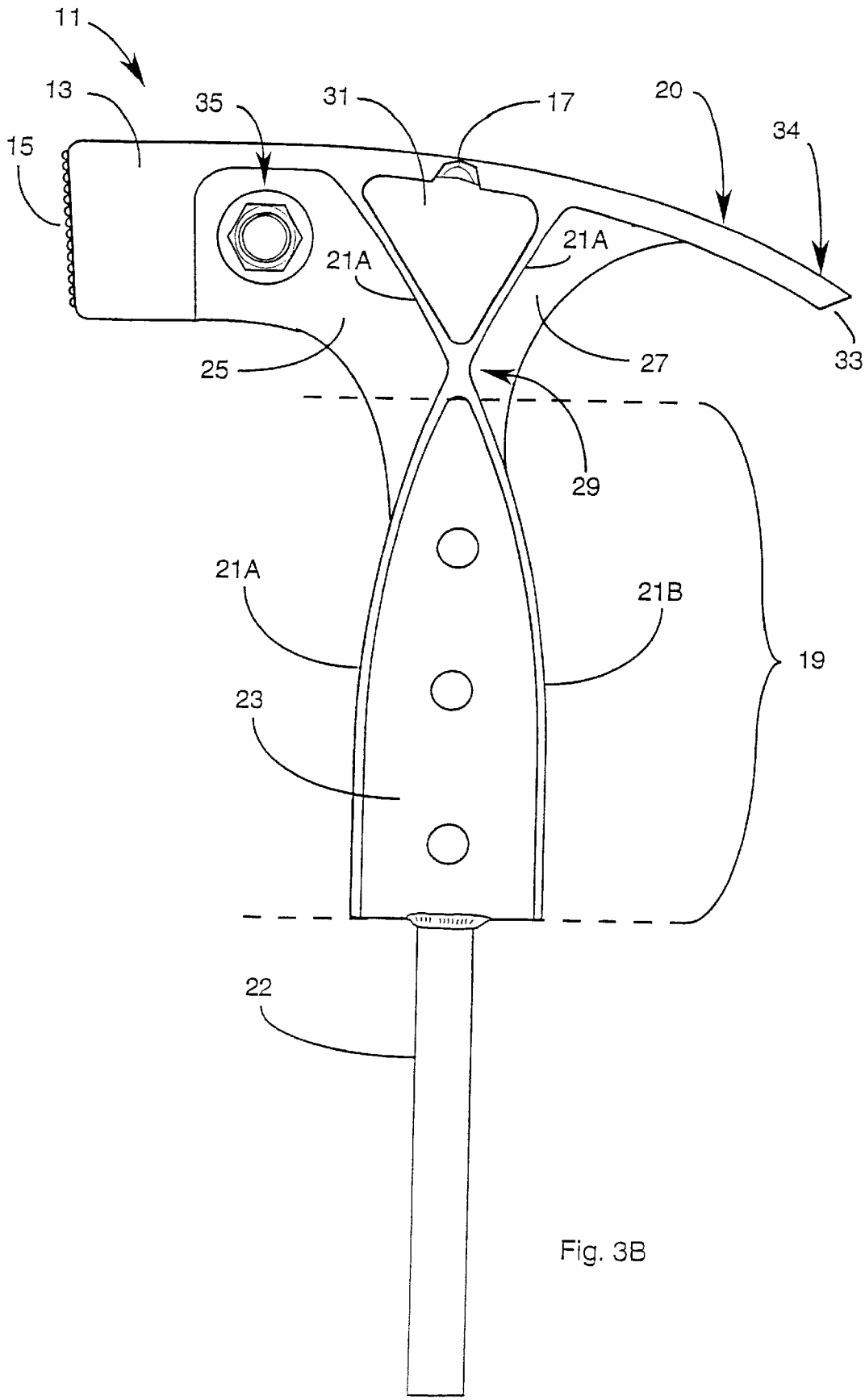
FIG. 3B is a left side view of the head and head-to-handle interface of the claw hammer of FIG. 2 according to another embodiment of the present invention.
Figure 4:
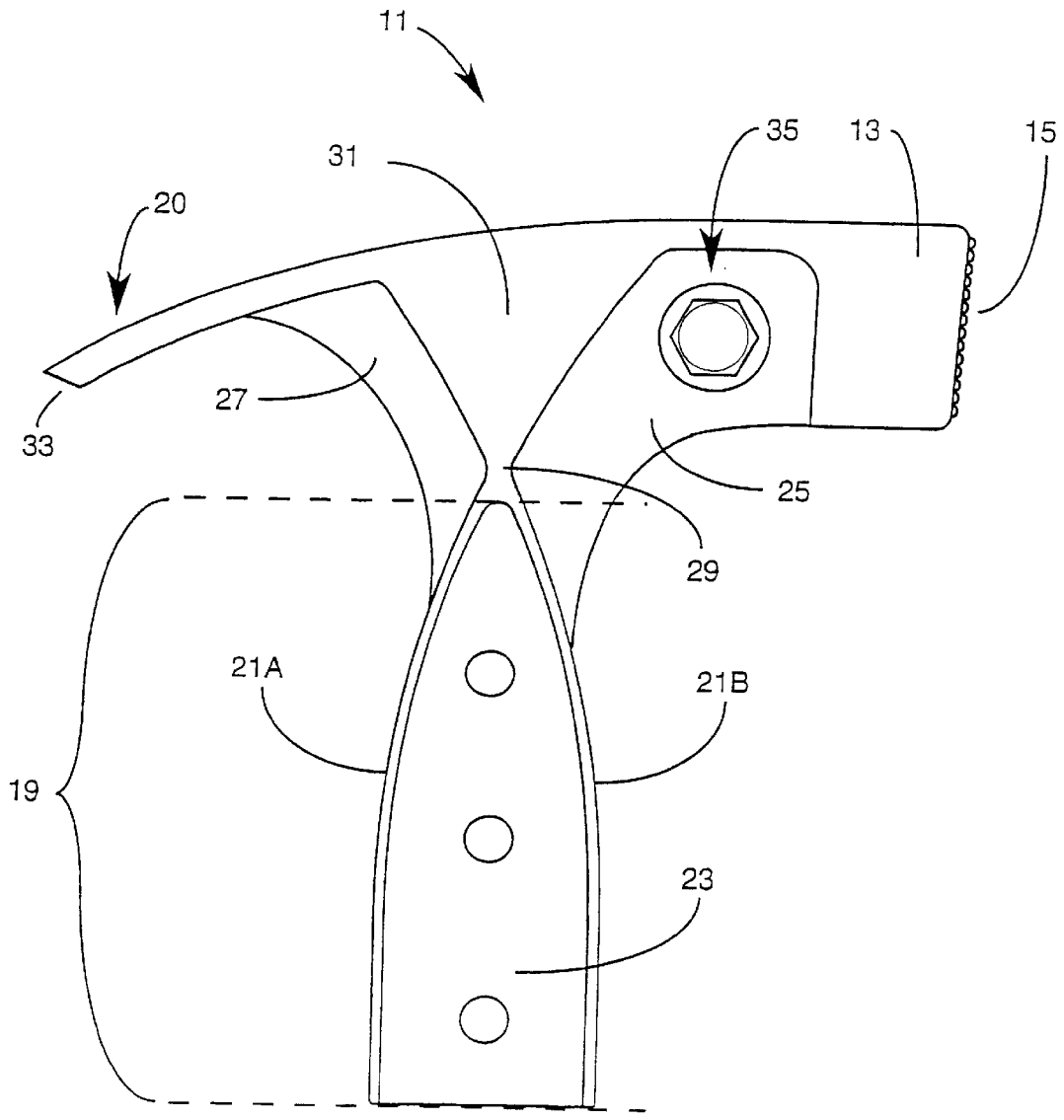
FIG. 4 is a right side view of the head and head-to-handle interface of the claw hammer of FIG. 2.

FIG. 4 is a side view of a hammer head 11, and shows a structure similar to that of FIGS. 3A, B, and C. Reinforcing web regions 25 and 27 are in the vertical plane of symmetry of the hammer head, which again may be better seen by referring to isometric view FIG. 8A. Portion 31 of the hammer head, substantially triangular in shape and enclosed on three sides of the triangle by claw section 20 and reinforcing braces 21A and 21B is open through the hammer head in some embodiments. In other embodiments a web 31 similar to webs 25 and 27 is provided coplanar in the plane of symmetry with webs 25 and 27. In the embodiment shown in FIGS. 3A and 4 web 31 is at one edge of the hammer head, opposite nail slot 17. In this manner web 31 forms an auxiliary striking surface on the side of the hammer head.

Braces 21A and 21B cross (and are joined) at region 29 and extend in a gentle curvature in the direction handle 37 assumes in the long axis (see FIG. 2) forming an enclosed region 16 having also a central web 23. This region, designated by a bracket and element number 19 in FIG. 3A, considering the two sides of the hammer head, forms a hammer-to-handle interface region having central web 23 and side-walls on each side provided by braces 21A and 21B.

Figure 8A:
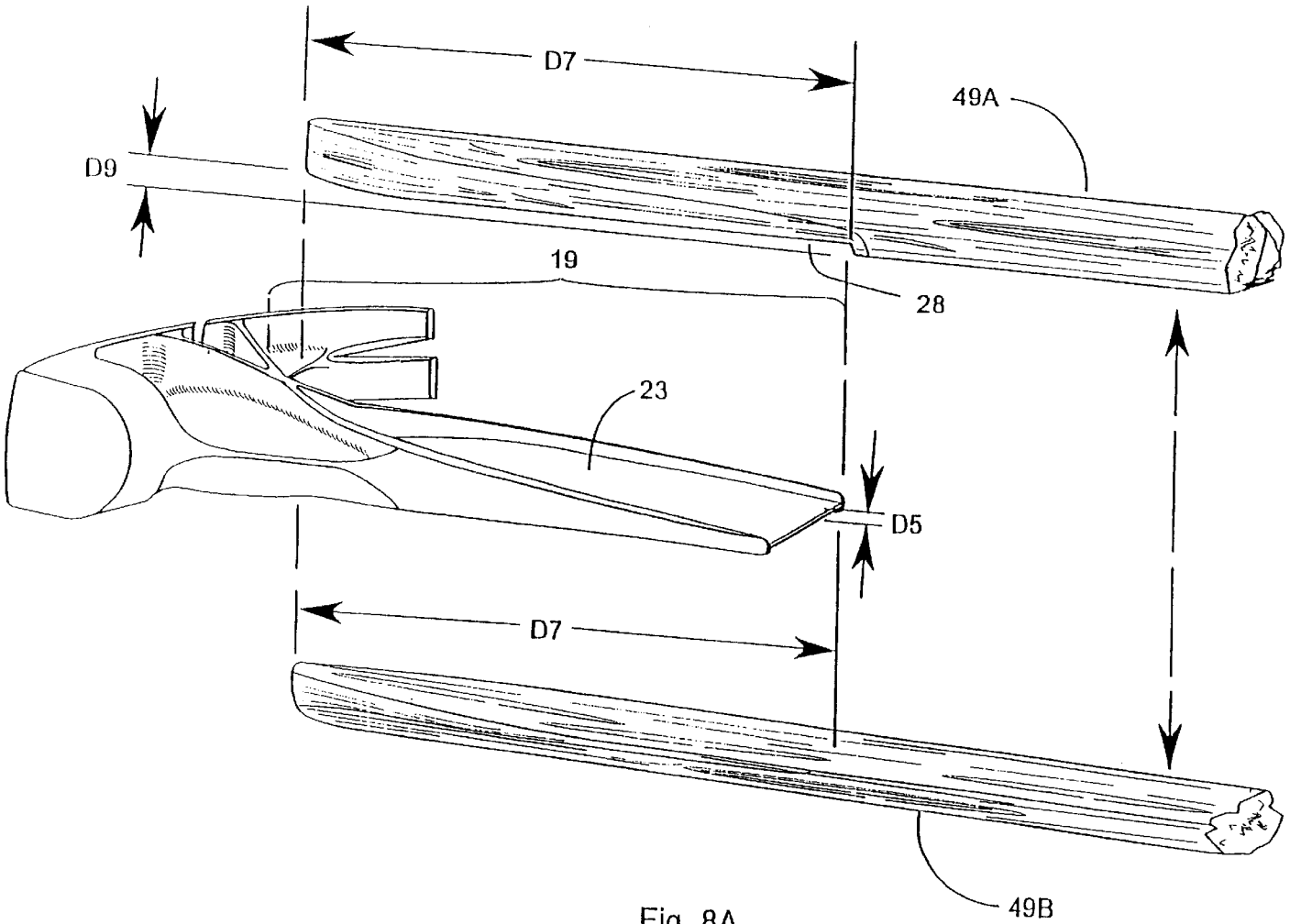
FIG. 8A is an exploded isometric view of a claw hammer head, handle, and head-to-handle Interface according to a preferred embodiment of the present invention.

As with other features of hammer head 11, the geometry of interface region 19 may be best understood by reference to FIG. 8A as well as FIG. 3A and FIG. 4.

Claw hammer head 11 as described above with reference to the Figs. is, in a preferred embodiment, forged from high carbon steel, although some other materials are also suitable. In alternative embodiments casting processes are used, and materials such as stainless steel are utilized.

Hammer head 11 with head-to-handle interface region 19 described above is shown as a single casting or forging, can also be assembled from separate components and connected by welding, brazing, riveting, riveted, epoxy bonding, or any suitable manner without departing from the spirit and scope of the invention.

Most hammer heads in the prior art are, as described above, monolithic, and if a head of a different weight is needed or wanted, the user must purchase a second hammer. In embodiments of the present invention variable head weight is provided by an adjustable weight assembly 35, which a user may change to accommodate current need.

Figure 5A:
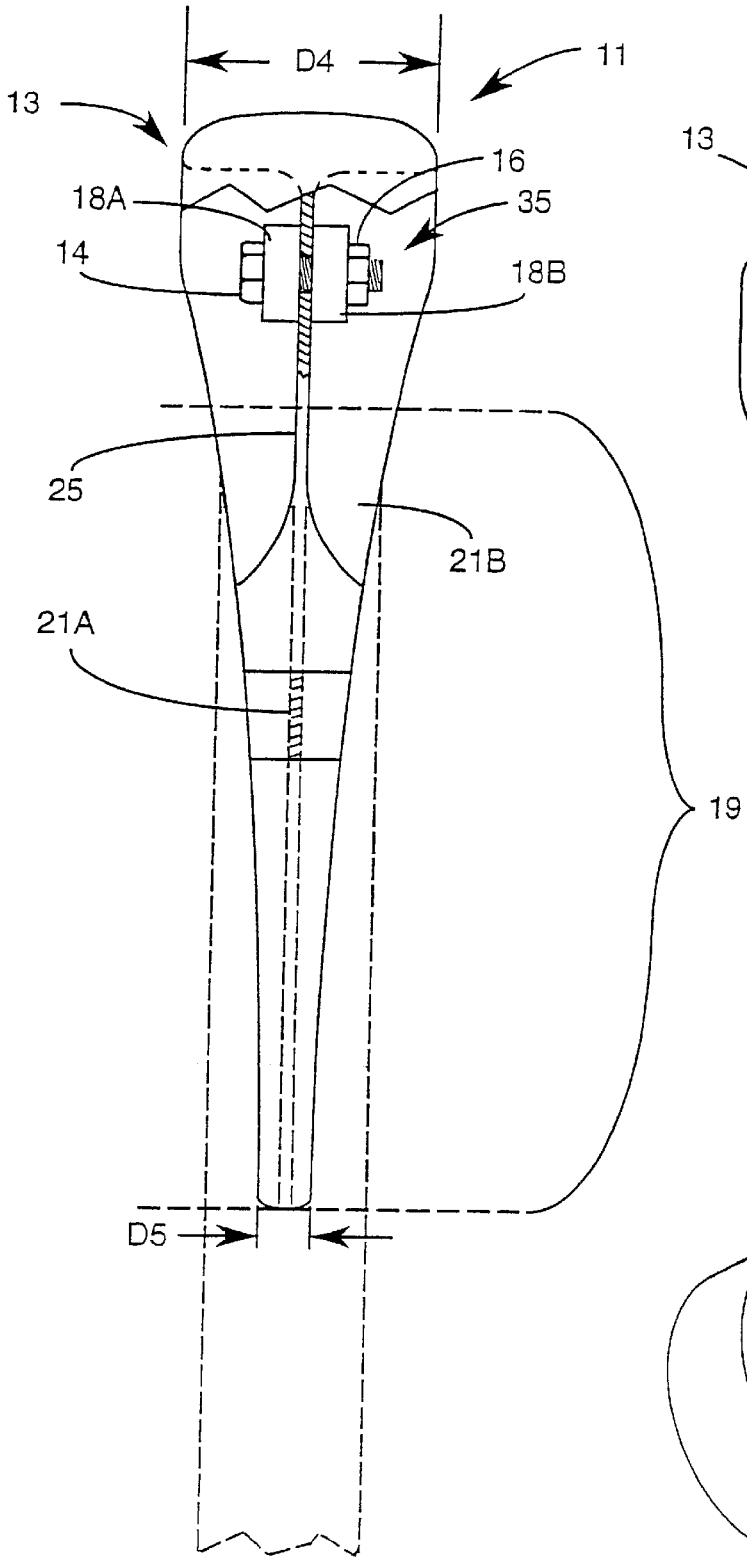
FIG. 5A is a front view of the head and head-to-handle interface of the claw hammer in FIG. 2.

FIG. 5A is a front view of the claw hammer head of FIG. 4, with a portion of the impact head cut away to show adjustable weight assembly 35, which is behind impact head 13 in this view. FIG. SB is an isometric view of a weight 18A–18B according to an embodiment of the invention. Given this unique feature, a user may adjust the weight, and therefore the inertia in operation, of the hammer head by removing and adding weights 18A and B. Weights of different sizes are provided in other embodiments.

In FIG. 5A it is seen that brace elements 21A and 21B taper away in the direction of the handle interface, starting with a combined height D4 of substantially the width of the hammer head and tapering to a width D5 of about one-fourth the width of the hammer head. This taper may be different in other embodiments.

Adjustable weight assembly 35 comprises a conventional bolt 14, a locking nut 16, and weights 18A and B. Weights 18A and B in are one pair of a variety of weights in different sizes that may be easily removed and added.

Weights 18A and B in the embodiment of FIG. 5A are cylindrical, but may be of any convenient shape without departing from the intent of the present invention. Although the weights are held in place by a bolt and locking nut in the embodiment shown, in other embodiments the weights may be fastened to the hammer head in a variety of ways. It is deemed important by the inventor that the weights be held securely, to avoid being jarred loose by virtue of the rather severe impacts experienced in use.

Figure 5C:
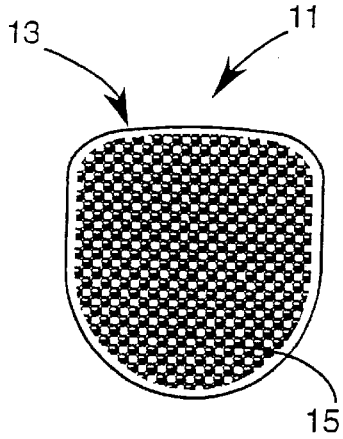
FIG. 5C is a face view of the traction surface of the hammer head.
Figure 5B:
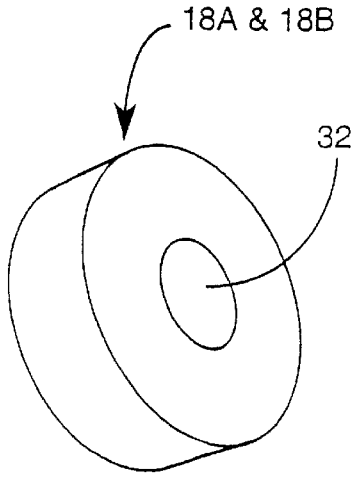
FIG. 5B is a isometric view of a weight according to an embodiment of the present invention.

FIG. 5C is a view of just the face of impact head 39 in the same direction as in FIG. 5A. This shape may vary in other embodiments, but has a semicircular lower aspect and an upper aspect with rounded corners. This shape allows a user to use the hammer in corners better than if the face were entirely circular.

Figure 6:
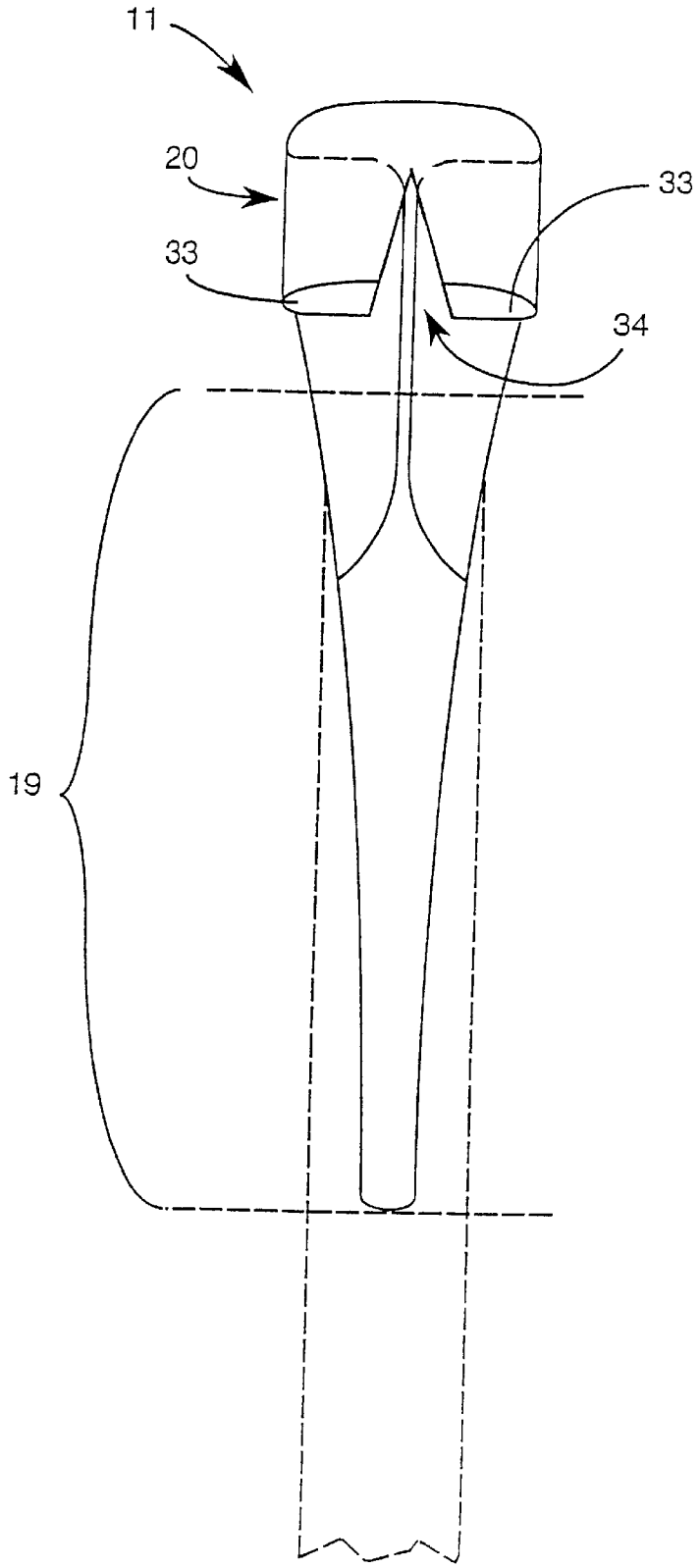
FIG. 6 is a rear view of the head and head-to-handle interface of the claw hammer in FIG. 2

FIG. 6 is a rear view of hammer head 11 of FIGS. 3A, 4, and 5A, showing claw 20, nail slot 34, and chamfered ends 33 from this vantage. Chamfered claw ends 33, to be described in more detail below, provide a sharp edge required for ripping tasks. Providing the ripping edge as a chamfer also allows claw 20 to be fashioned in substantially uniform thickness as described with reference to FIG. 3A. This provides improved strength over conventional claw hammers, which is an advantage for nail pulling and ripping tasks.

Figure 7:
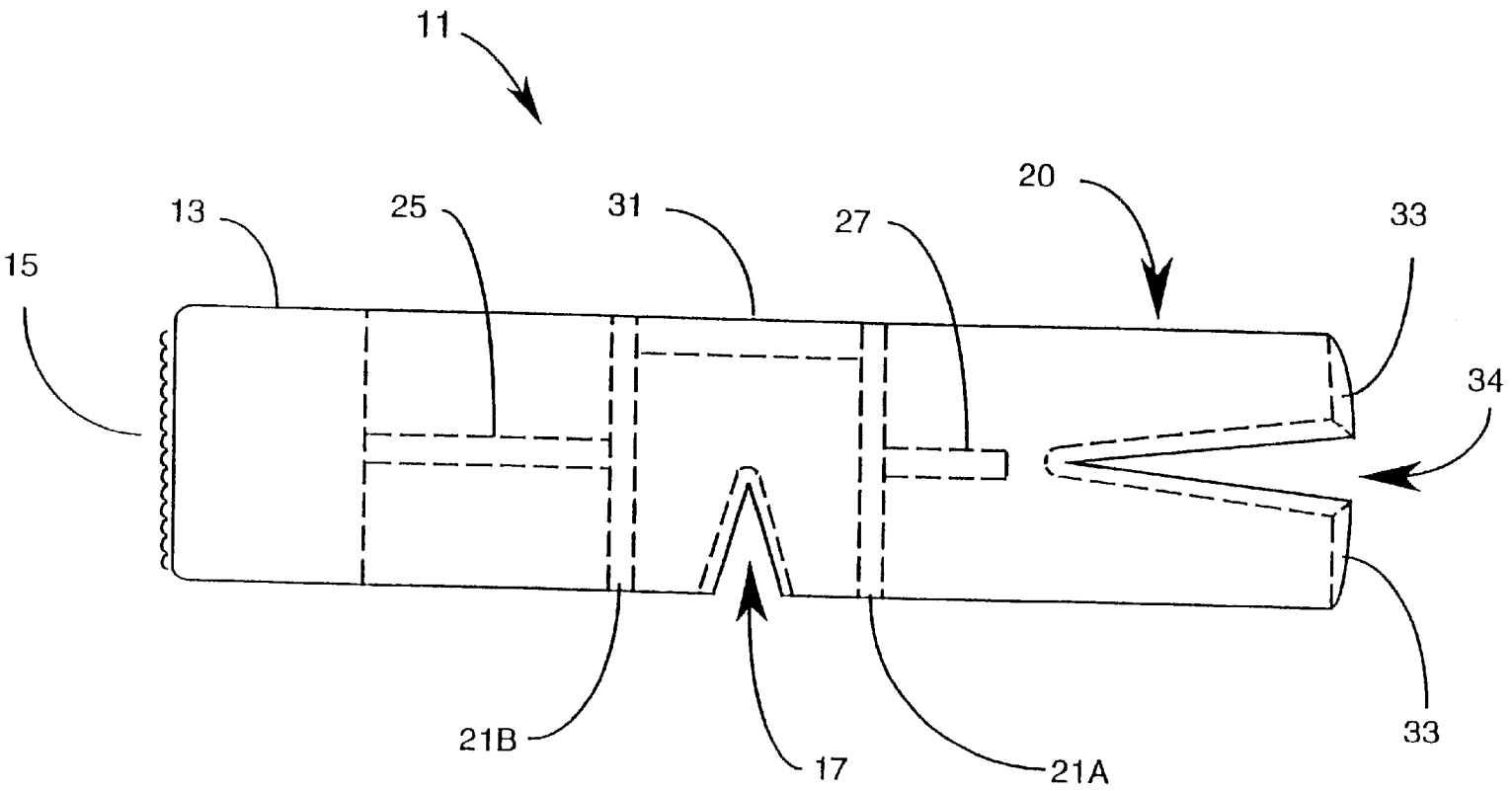
FIG. 7 is a top view of the head and head-to-handle interface of the claw hammer in FIG. 2.

FIG. 7 is a top view of hammer head 11, showing connectivity of web 25, web 27, braces 21A and 21B, and center web 31. As described above, the structure may be of a single piece, as with a forging or a casting, or may be fabricated by welding from separate parts.

Center web 31 is aligned in the embodiment shown flush with one side of the hammer head. In other embodiments this wall structure may be centrally located, as with webs 25 and 27. The location of this web, if used, should not block side nail-pulling slot 17. In some embodiments the head may be open through this area with no web 31. The placement of web 31 to the far side of the head from side nail-pulling slot provides a side striking surface for the hammer, which is convenient in many situations.

FIG. 8A is an exploded isometric view of hammer head 11 and a two-piece handle comprising parts 49A and 49B in an embodiment of the present invention. Handle part 49A has a recessed area 28 with a height D9 and length D7. Height D9 and length D7 substantially correspond to thickness D5 and length D7 of interface web 23. The purpose of this recessed area is to accommodate web 23 in assembly while allowing the two portions of the handle to come together. The recess can be in either handle portion, and in some embodiments with two-part handles the recess may be in both handle portions, each with a depth of one-half the thickness of web 23.

Each of handle parts 49A and 49B has a nose region shaped to fit a matching socket provided on each side of head-to-handle interface region 19 of hammer head 11. This shape includes, on each part, surfaces to match the inside surfaces formed by brace elements 21A and 21B on each side of the head-to-handle interface.

Handle parts 49A and 49B come together in the sockets on each side of the head-to-handle interface and are joined by fasteners 30 (see FIG. 2). In embodiments utilizing such fasteners, opening through web 23 are provided, even though these openings are not shown in FIG. 8A. The fasteners can be any of a number of conventional types, such as rivets or screw thread fasteners with large decorative heads. In some embodiments an adhesive filler may be used to assure a secure bond in joining the two handle parts to the hammer head.

As has been described above, and as may be better understood with reference to FIG. 2, bending moments are produced in planes parallel to the major axis of symmetry of the hammer as the hammer is used, either in impacting a nail or a surface with impact head 13 or in nail pulling or ripping operations with claw 20. In a conventional hammer (FIG. 1B) these moments are concentrated in a small area 48. In the hammer of FIG. 2 these effects are spread over a the entire handle area in interface region 19, and absorbed by the inner surfaces of brace elements 21A and 21B along the length of region 19. Stress and strain are therefore very much less, and the hammer assembly may be expected to be much more reliable and durable than has been available in the art.

In those embodiments having a side nail-pulling slot 17 (see FIG. 7), the force applied to the hammer handle in pulling nails and in use of striking surface 31 is at right angles to the force applied in striking with impact head 13 and in nail pulling and ripping with claw 20 and nail-pulling slot 34. Bending moments produced in these operations are then at right angles to those produced in impacting with head 13 and in nail pulling and ripping with claw 20 (slot 34). The forces in this case are spread over the surface areas of web 23, and the stresses and strains produced are much lower than in the conventional case.

Figure 8B:
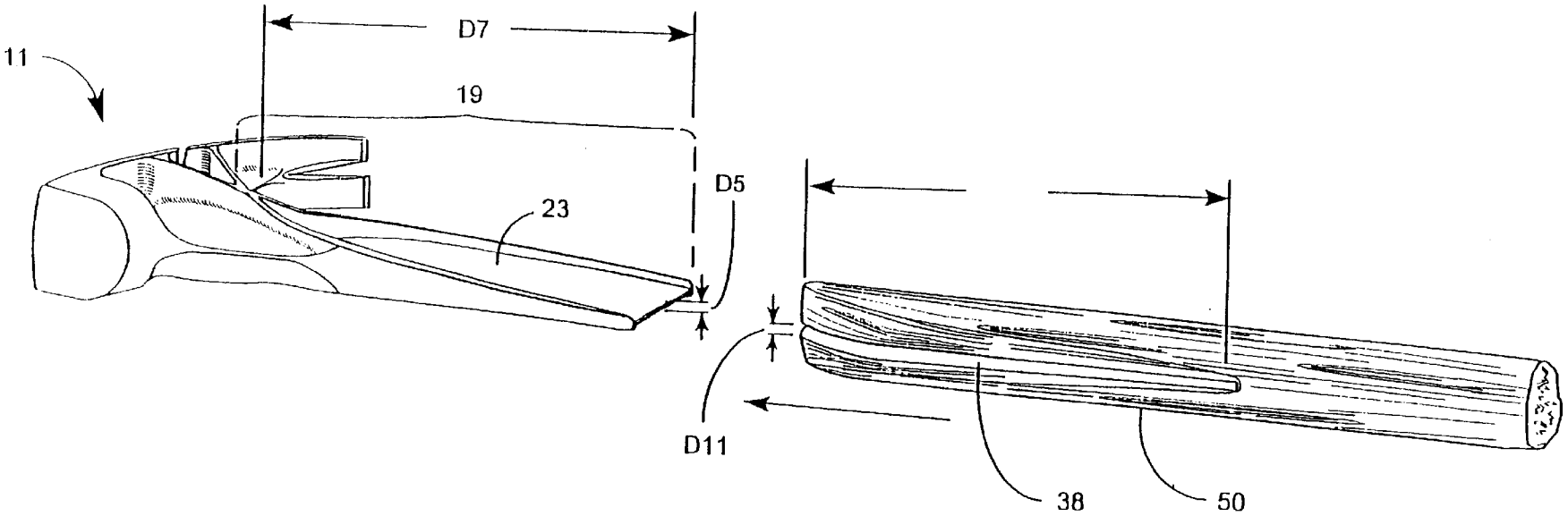
FIG. 8B is an exploded view of a claw hammer head, handle, and head-to-handle Interface according to another embodiment of the present invention.

FIG. 8B is another exploded view of claw hammer head 11 and a handle according to another embodiment of the present invention. In this embodiment the handle is a single piece having a slot 38 of height D11 and length D22, which corresponds dimensionally to height D5 and length D7 of interface region 19. Handle 37*a* in assembly simply slides into place, filling the sockets created by web 23 and sidewalls of brace elements 21A and 21B, and is fastened by the expedients described above for the two-piece handle with reference to FIG. 8A.

In alternative embodiments of the present invention a center spine 22 (FIG. 3) is provided, welded or otherwise fastened to web 23 to provide a high-strength inner axis for a handle. In these embodiments, appropriate grooves may be provided in wooden handle parts to accommodate the inner spine, or a handle may be molded-in-place from, for example, a polymer material, still filling the interface region 19, which, even in this case, provides additional strength and durability.

As also mentioned above, the unique head-to-handle interface has been described by the example of a claw hammer. A claw hammer, however, is not the only tool which might well benefit from such an interface. The interface is applicable to nearly all sorts of striking and pulling tools.

Figure 9B:
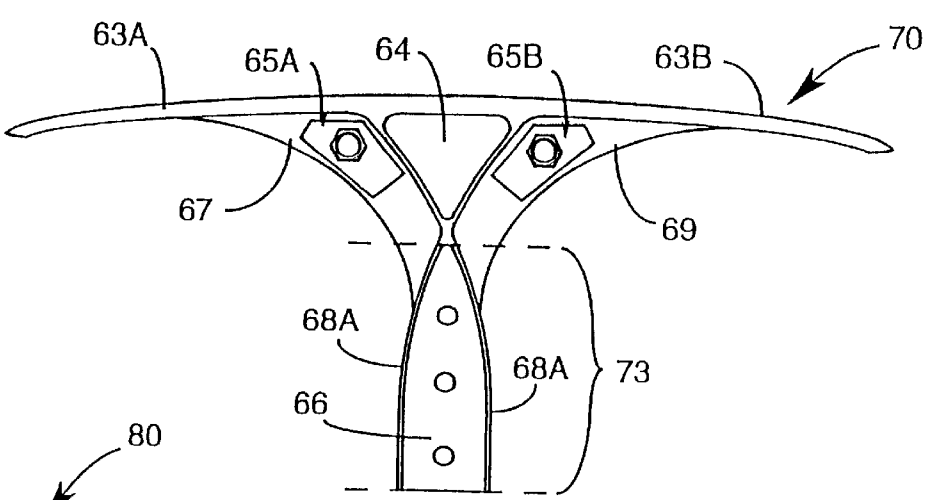
FIG. 9B is a left side view of a pickaxe head and head-to-handle interface according to an embodiment of the present invention.
Figure 9A:
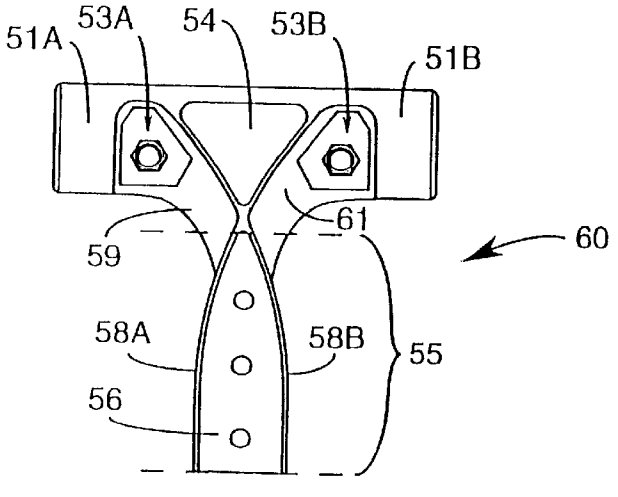
FIG. 9A is a left side view of a sledge hammer head and head-to-handle interface according to an embodiment of the present invention.
Figure 9C:
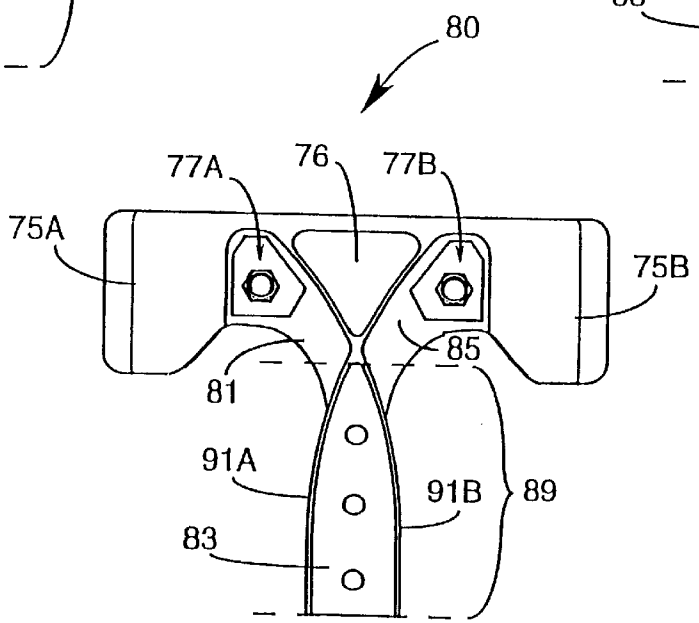
FIG. 9C is a left side view of an axe head and head-to-handle interface according to an embodiment of the present invention.

FIGS. 9A, 9B, and 9C show different types of striking tool heads illustrating the versatility of applications for the present invention. FIG. 9A is an elevation view of a sledge hammer head 60 with a head-to-handle interface 55 according to an embodiment of the present invention. There are two opposite impact heads 51A and 51B, and weight assemblies 53A and 53B. In addition there are a center web 54, front web 59, rear web 61, interface web 56, and brace elements 58A and 58B.

The general construction of sledge hammer head 60 corresponds to the construction of hammer head 11 described in detail above, including head-to-handle interface 55 corresponding to head-to-handle interface 19 described above. There are also variable weight assemblies 53A and 53B corresponding to variable weight assembly 35 in the hammer embodiment. This feature is optional.

FIG. 9B shows a pickaxe head 70 with head-to-handle interface 73 according to an embodiment the present invention. Pickaxe head 70 has impact heads 63A and 63B, variable weight assemblies 65A and 65B, a center web 64 (optional), a front web 67, a rear web 69, interface web 66, and two brace elements both marked 68A. Impact heads 63A and 63B have a substantially pointed or bladed surface to suit traditional uses of a pickaxe.

FIG. 9C shows an axe head 80 with a head-to-handle interface 89. Axe head 80 has impact heads 75A and 75B, variable weight assemblies 77A and 77B, a center web 76 (optional), front web 81, rear web 85, interface web 83, and brace elements 91A and 91B. Impact heads 75A and 75B have a wedges cutting edges to suit traditional uses of an axe.

Figure 11A:
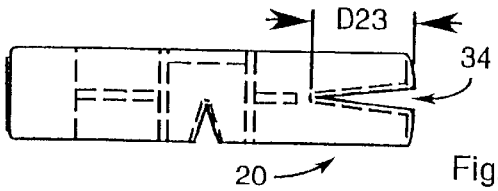
FIG. 11A is a top view of a claw hammer according to a preferred embodiment of the present invention.
Figure 11B:
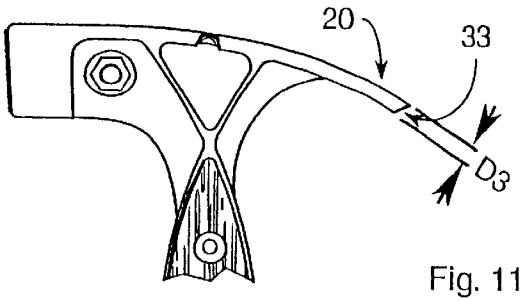
FIG. 11B is a left side view of the claw hammer of FIG. 11A.
Figure 11C:
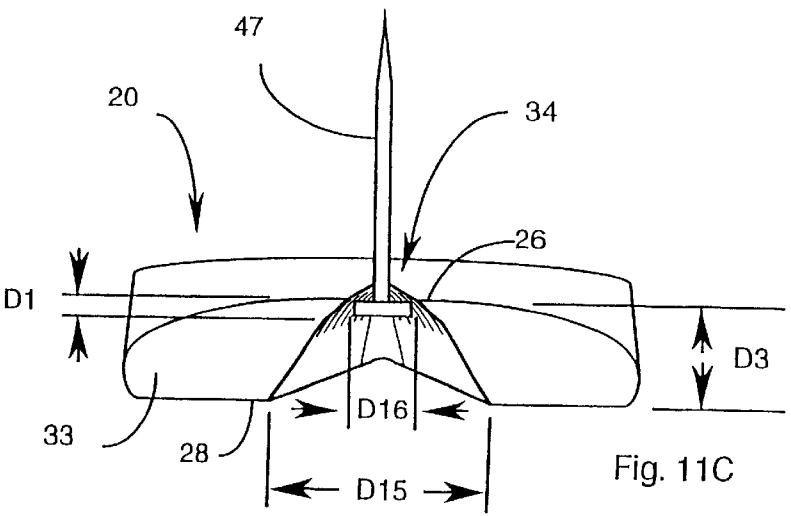
FIG. 11C is an enlarged rear view of a claw hammer claw of the claw hammer of FIGS. 11A and 11B.
Figure 10A:
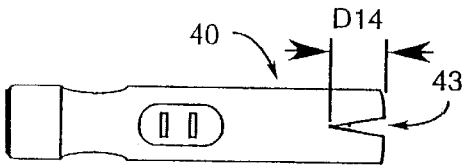
Fig. 10A (Prior Art)
FIG. 10A is a top view of a claw hammer according to conventional art.
Figure 10B:
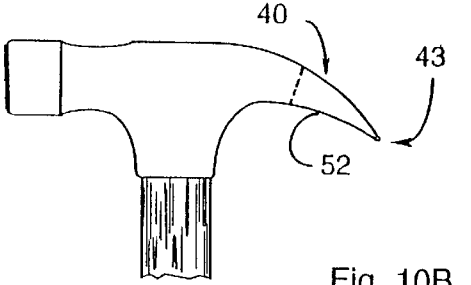
Fig. 10B (Prior Art)
FIG. 10B is a left side view of the claw hammer of FIG. 10A.
Figure 10C:
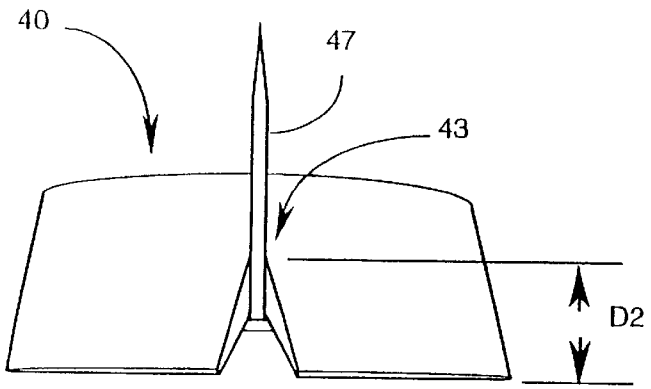
Fig. 10C (Prior Art)
FIG. 10C is an enlarged rear view of the claw hammer claw of FIGS. 10A and 10B.

FIGS. 10A, 10B, and 10C are top, left elevation, and enlarged rear views of a conventional claw hammer, showing a claw and nail pulling slot according to conventional art. FIGS. 11A, 11B, and 11C are top, left elevation, and enlarged rear views of a claw hammer in an embodiment of the present invention, showing a claw and nail pulling slot according to the present invention.

Conventional claw 40 (FIGS. 10A, 10B, and 10C) is either substantially curved or only slightly curved, depending on intention as a nail-pulling claw or a ripping claw. In both cases, the working end of claw 40 is wedge-shaped and has a nail slot 43 (FIG. 10C) whose height conforms to the thickness of wedge region 43 in FIG. 1B, which may vary along the wedge length D14 (FIG. 10A). In a conventional claw the sidewalls of the nail-pulling slot are vertical, so, when pulling nails, the underside of the nail head is held against opposite surface 52. Because of this, a nail with its head very close to a surface wherein the nail is embedded cannot be fully engaged and pulled with a single stroke. One must first engage the nail head with just the tip of the slot, then work the nail further into the slot as it is withdrawn incrementally from the wood or other material within which it is embedded.

FIGS. 11A, 11B and 11C show a top view, a side elevation view, and a rear elevation view of hammer head 11 having claw 20 and nail-pulling slot 34. In contrast to a conventional nail-pulling slot, slot 34 has angled sidewalls such that the width of the slot at the undersurface of the claw is substantially greater than at the top surface, as seen in FIG. 11C. That is, dimension D15 is substantially greater than dimension D16. This taper is such that most conventional nail heads are held within slot 34 rather than against a surface of the claw. In a preferred embodiment the included angle is equal to or greater than forty degrees. An advantage is that the claw can be of a grater thickness near the end having the nail-pulling slot than is possible with a conventional claw, providing increased strength and durability.

Claw 20 is substantially straighter than the curved claw of a conventional nail-pulling claw hammer and more closely resembles the curvature of a conventional ripping claw. Claw 20 also has a substantially constant thickness D3 (FIGS. 11B, 11C, and FIG. 3A). A sharp edge for ripping tasks is provided by chamfered claw end 33.

Figure 3C:
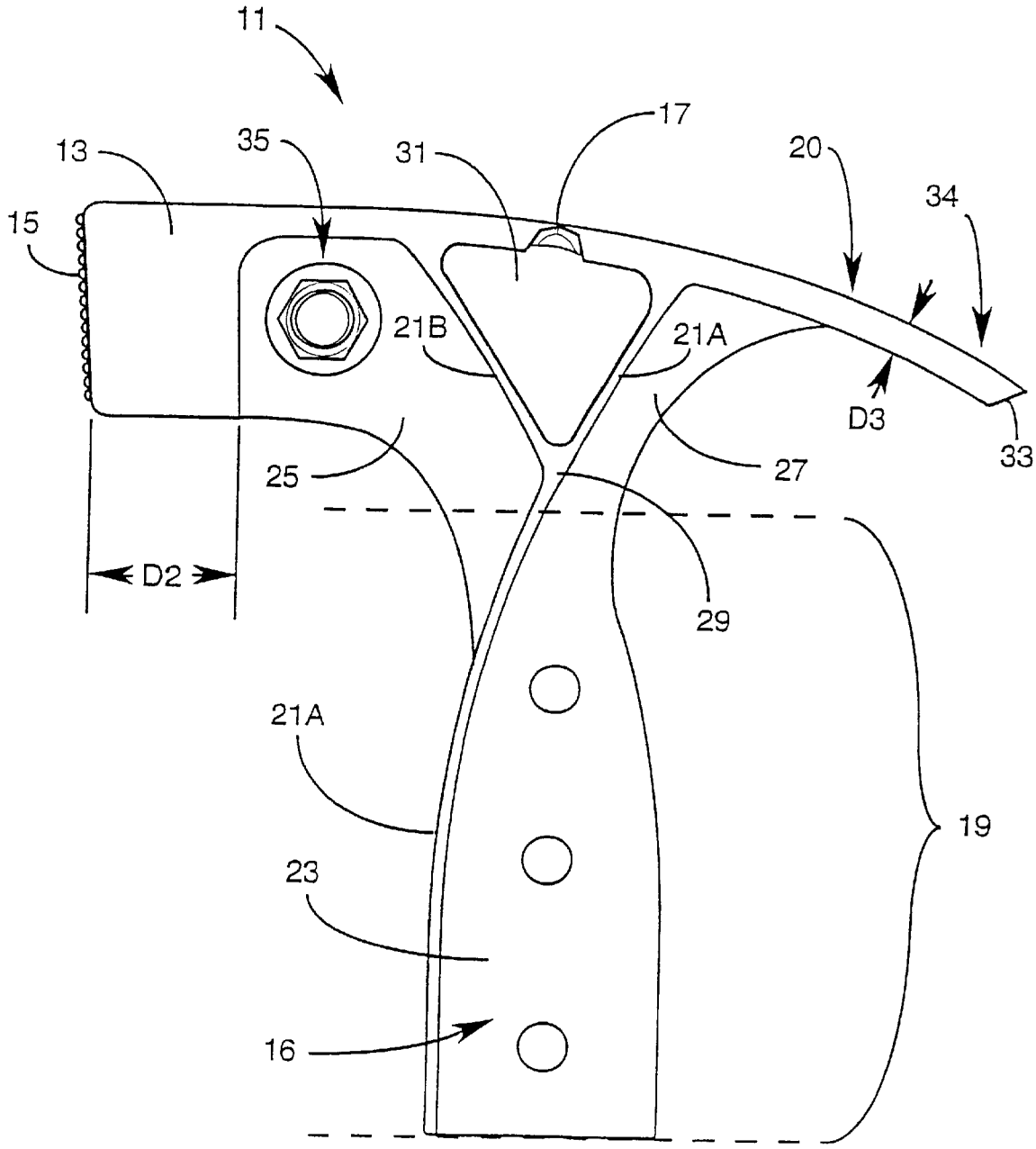
FIG. 3C is a side elevation view of the head and head-to-handle interface of a claw hammer according to an alternative embodiment of the present invention.

In some embodiments of the present invention the brace elements shown as 21A and 21B in FIG. 3A do not provide sidewalls all around the periphery of web 23, but only on one edge of web 23. FIG. 3C is a side elevation view of a hammer head and a head-to-handle interface according to this embodiment. In this embodiment brace element 21A extends the full length of web 23, and forms side walls orthogonal to web 23 on opposite sides of web 23, but web 21B extends only to web 21A, and does not form a sidewall to web 23. In this instance web 23 and web 27 are contiguous.

The inventors have found that in some embodiments sidewalls are not really necessary on both edges of web 23 in the head-to-handle interface, and as long as a handle is securely joined to the web and abutts the one sidewall, sufficient strength is imparted for striking and other tasks to be performed by a tool having the interface.

It will be apparent to those with skill in the art that there are many alterations that may be made in the embodiments described above without departing from the spirit and scope of the invention. For example, the specific shape of the elongated, edge-walled head-to-handle interface described may vary considerably from the embodiment shown in the drawings of this disclosure without departing from the scope of the invention. Some of the curvature and shaping is for aesthetic effect. The novelty in the interface is the presence of the center web (element 23 in FIG. 8A) and the sidewalls on three sides provided by the brace elements (elements 21A and 21B).

There are many other variations that may be made. There are, for example, many ways handles may be fastened to heads of striking tools in embodiments of the invention. Several fasteners and adhesive fastening are described above. Handles may be of wood in a preferred embodiment, and many professionals still prefer wooden handles. Other materials may be used, however, such as molded polymer materials. There are similarly many ways variable weights may be provided and held in place other than the specific embodiments described. The invention is limited only by the language of the claims which follow.

What is claimed is::

1. A striking tool comprising:

a head having a plane of substantial symmetry, a central handle interface region for joining a handle to the head in a manner constraining the handle to extend in a first direction away from the head, and a first striking region including a first striking surface at a first end of the head extending away from the handle interface region in a second direction substantially at a right angle to the first direction, the second direction being a direction of action for engaging the striking region;

a handle having a length, the handle engaged by the handle interface region and extending away from the head in the first direction; and a first metal guard strip on the handle, the guard strip extending below the head for a portion of the handle length and facing in the second direction.

2. The striking tool of claim 1 further comprising a second end extending from the handle interface region in a third direction away from the handle interface region, the third direction also at substantially a right angle to the first direction and opposite the second direction.

3. The striking tool of claim 2 further comprising a second metal guard strip on the handle, the second metal guard strip extending below the head for a portion of the handle length and facing in the third direction.

4. The striking tool of claim 3 wherein the second end of the head comprises a second striking region including a second striking surface, the third direction being a direction of action for engaging the second striking region.

5. The striking tool of claim 3 wherein the striking tool is a hammer, and the second end comprises a claw region.

6. The striking tool of claim 1 wherein the first striking region has a width in a fourth direction substantially at a right angle to the plane of substantial symmetry, and further comprising a web in the plane of substantial symmetry between the striking region and the handle interface region, the web having a thickness in the fourth direction substantially less than the width of the first striking region.

7. The striking tool of claim 2 further comprising a web between the second end and the central handle interface region, the web having a thickness in the fourth direction substantially less than the width of the first striking region.

8. A head for a hammer, the head having a plane of substantial symmetry and comprising:

a central handle interface region for joining a handle to the head in a manner constraining the handle to extend in a first direction; and a striking region extending to one side of the handle interface region in a second direction substantially at a right angle to the first direction and ending in a striking surface at a first end of the head;

characterized in that the striking surface, viewed along the second direction toward the head with the first direction downward, has a shape defined by two rounded top corners, substantially straight sides depending downward from the rounded corners, and a bottom continuous curve joining both of the substantially straight sides tangentially.

9. A head for a hammer, the head having a plane of substantial symmetry and comprising:

a central handle interface region for joining a handle to the head in a manner constraining the handle to extend in a first direction;

a striking region extending to one side of the handle interface region in a second direction substantially at a right angle to the first direction and ending in a striking surface at a first end of the head; and a nail-pulling claw region disposed to another side of the handle interface region opposite the striking region in the second direction, ending in a second end of the head;

characterized in that the head has a smooth, unbroken top surface from the first end to the second end, joining the regions of the head.

10. A hammer comprising:

a head; and a handle;

characterized in that the head has a central handle interface region for joining a handle to the head in a manner constraining the handle to extend in a first direction, and a striking region extending to one side of the handle interface region in a second direction substantially at a right angle to the first direction and ending in a striking surface at a first end of the head, and in that the striking surface, viewed along the second direction toward the head with the first direction downward, has a shape defined by two rounded top corners, substantially straight sides depending downward from the rounded corners, and a bottom continuous curve joining both of the substantially straight sides tangentially.

11. A hammer comprising:

a head; and a handle;

characterized in that the head has a central handle interface region for joining a handle to the head in a manner constraining the handle to extend in a first direction, a striking region extending to one side of the handle interface region in a second direction substantially at a right angle to the first direction and ending in a striking surface at a first end of the head, and a nail-pulling claw region disposed to another side of the handle interface region opposite the striking region in the second direction, ending in a second end of the head, and in that the head has a smooth, unbroken top surface from the first end to the second end, joining the regions of the head.

* * * * *